US007597054B1

(12) United States Patent
Grove

(10) Patent No.: US 7,597,054 B1
(45) Date of Patent: Oct. 6, 2009

(54) COLLAPSIBLE DESK

(76) Inventor: James E. Grove, 4316 Marina City Dr., #423CTN, Marina del Rey, CA (US) 90292

( * ) Notice: Subject to any disclaimer, the term of this patent is extended or adjusted under 35 U.S.C. 154(b) by 0 days.

(21) Appl. No.: 11/384,463

(22) Filed: Mar. 20, 2006

(51) Int. Cl.
*A47B 1/04* (2006.01)

(52) U.S. Cl. ..... 108/77; 108/156

(58) Field of Classification Search ..... 108/156, 108/69, 65, 77, 80, 36, 166, 169, 173, 174, 108/176, 179, 128, 129, 130, 131, 132, 124, 108/155, 157.1, 159.11, 159.12, 158, 158.11, 108/158.12, 158.13, 160, 157.16; 248/188, 248/188.1; 403/256, 257, 258, 259, 260, 403/261, 262, 199, 200
See application file for complete search history.

(56) References Cited

U.S. PATENT DOCUMENTS 290,734 A * 12/1883 Brenn ..... 108/130
643,511 A * 2/1900 Lloyd ..... 108/36
1,049,283 A * 12/1912 Westphal ..... 285/209
1,269,193 A * 6/1918 Kelly ..... 108/156
1,762,776 A * 6/1930 Gardner ..... 403/189
2,297,647 A * 9/1942 Chason ..... 108/69
2,433,315 A * 12/1947 Bieszki ..... 108/36
2,837,392 A * 6/1958 Straits ..... 108/160
2,970,024 A * 1/1961 Urban ..... 108/160
6,705,234 B1 * 3/2004 Miller et al. ..... 108/36
6,820,847 B2 * 11/2004 Camarota et al. ..... 248/188

* cited by examiner

*Primary Examiner*—Janet M Wilkens
(74) *Attorney, Agent, or Firm*—Morland C. Fischer

(57) ABSTRACT

A desk that has a working platform which has a set of legs that are mounted on the bottom surface of the working platform. The legs are pivotable from a retracted position in juxtaposition with the working platform to an outwardly extended position located transverse to the working platform. Attached to each leg is a brace and this brace is swingable to engage the outer free end of the brace with an attaching plate that is fixed relative to the bottom surface of the working platform. There is a separate attaching plate for each leg. With the brace clamped to the attaching plate, each leg will be securely positioned in the extended position permitting the working platform to rest in a spaced relationship relative to a supporting surface permitting a chair to be used in conjunction with the desk with a human user to be located in the chair and the user to then perform tasks on the desk.

10 Claims, 2 Drawing Sheets

COLLAPSIBLE DESK

BACKGROUND OF THE INVENTION

1. Field of the Invention

This invention relates to furniture and more particularly to a desk that is constructed to be collapsible so that it will occupy a smaller size configuration during shipping and the user of the desk can quickly and easily expand the desk to its usage position.

2. Description of the Related Art

The structure of a desk has long been known. Desks take numerous configurations. A typical desk is not collapsible. Non-collapsible desks sometimes are not able to be located within certain rooms of a house or place of business because it is just impossible to get the desk through confined hallways and doorways to get it into the desired location.

For such confined quartered locations and other non-confining locations, there have been constructed in the past collapsible desks. The basic construction of a collapsible desk comprises a working platform and a plurality of legs, usually four in number. The user must assemble the desk after purchase with this assembly generally being at the location of usage of the desk. There is normally a lengthy set of instructions that accompanies the desk with these instructions to be followed to achieve the precise mounting of the legs to the working platform of the desk. It is not at all unusual for an individual to actually take several hours in order to construct such a collapsible desk.

It would be desirable to design a collapsible desk which when collapsed will be substantially smaller in size facilitating shipping of the desk and when purchased by the user can be assembled to the usage position in a matter of a minute or two. Also, it would be desirable that the assembly of the desk not require the use of any handtools, such as screwdrivers, hammers and wrenches.

SUMMARY OF THE INVENTION

A first basic embodiment of collapsible desk which has a working platform which has an upper surface and a bottom surface. The working platform has a right peripheral edge and a left peripheral edge. A right leaf is mounted at the right peripheral edge and a left leaf is mounted at the left peripheral edge. The right leaf is capable of pivoting movement from an aligned position aligned with the working platform to a right angled position relative to the upper surface of the working platform. The left leaf is capable of similar pivoting movement relative to the working platform. A first pair of spaced apart elongated legs are mounted on the right leaf and a second pair of spaced apart elongated legs are mounted on the left leaf. Each leg is locatable in either a retracted position or an extended position. With the legs in the retracted position, the legs are located in juxtaposition with the bottom surface of the working platform. With the legs in the extended position, the legs are located substantially at a right angle to the bottom surface. A rod shaped brace is attached to each leg with there being a separate brace for each leg. Each brace has an outer free end. Each brace is pivotable on its respective leg from an unengaged position to a locking position. Each brace is in the unengaged position when the legs are in the retracted position. Each brace is able to be in the locking position only when the legs are in the extended position. Each outer free end is removably securable with a separate attaching plate when in the locking position which will fixedly position the legs in the extended position. Each attaching plate is fixed relative to the working platform.

A further embodiment of the present invention is where the first basic embodiment is modified by defining that the outer free end of each brace terminates in a disc with this disc to interlock with the attaching plate. A collar is threadably mounted on each leg. The collar to be manually turned to tightly clamp the attaching plate between the collar and disc to provide a rigid securement for each leg.

A further embodiment of the present invention is where the first basic embodiment is modified by defining that each brace has an inner end that is attached to a sleeve with the sleeve being mounted on the leg, which is cylindrical, and each sleeve is pivotally mounted on the leg directly adjacent an outer end of the leg.

A further embodiment of the present invention is where the first basic embodiment is modified by defining that each brace is arcuately shaped.

A further embodiment of the present invention is where the first basic embodiment is modified by defining that the upper surface of the working platform is planar.

A second basic embodiment of the present is directed to a desk that is collapsible from a usage position to a smaller sized shipping position, the desk comprises a working platform having an upper surface and a bottom surface, the working surface has a peripheral edge, a leaf is mounted to the peripheral edge with the leaf being movable between an aligned position aligned with the working platform to a deflected position locating the leaf transverse to the working platform. An elongated leg is mounted on the leaf with the leg being movable between a retracted position and an extended position. With the leg in the retracted position, the leg is locatable in juxtaposition with the bottom surface. With the leg in the extended position, the leg is locatable substantially transverse to the bottom surface. An elongated brace is attached to the leg. The brace has an outer free end. The brace is pivotable on the leg from an unengaged position to a locking position. The brace is in the unengaged position when the leg is in the retracted position. The brace is able to be in the locking position only when the leg is in the extended position. The outer free end is removably securable with an attaching plate when in the locking position which will fixedly position the leg in the extended position. The attaching plate is fixed relative to the working platform.

A further embodiment of the present invention is where the second basic embodiment is modified by defining that the outer free end of the brace terminates in a disc with this disc to interlock with the attaching plate. A collar is threadably mounted on the leg with the collar to be manually turned to tightly clamp the attaching plate between the collar and the disc to provide a rigid securement for the leg.

A further embodiment of the present invention is where the second basic embodiment is modified by defining that each brace has an inner end that is attached to a sleeve with this sleeve being located in conjunction with the leg that is cylindrical. The sleeve is pivotally mounted on the leg directly adjacent the outer end of the leg.

A further embodiment of the present invention is where the second basic embodiment is modified by defining that the brace is arcuately shaped.

A further embodiment of the present invention is where the second basic embodiment is modified by defining that the upper surface of the working platform is defined as being planar.

A third basic embodiment of the present invention is directed to a desk that is collapsible from a usage position to a smaller sized shipping position. There is a working platform that has an upper surface and a bottom surface with the working platform having a peripheral edge. The upper surface is to be usable by a human while performing tasks. An elongated leg is mounted on the bottom surface when in an installed position. The leg is movable from the installed position to an uninstalled position disengaged from said working platform. With the leg in the uninstalled position, the leg may be placed in juxtaposition with the bottom surface. With the leg in the installed position, the leg is located substantially transverse to the bottom surface. An elongated brace is attached to the leg with the brace having an outer free end. The brace is pivotable on the leg from an unengaged position to a locking position. The brace is in the unengaged position when the leg is in the uninstalled position. The brace is able to be in the locking position only when the leg is in the installed position. The outer free end is removably securable within an attaching plate. When in the locking position, it will maintain the leg in the installed position. The attaching plate is fixed relative to the working platform.

A further embodiment of the present invention is where the third basic embodiment is modified by defining that the outer free end terminates in a disc and the disc is to interlock with the attaching plate. A collar is threadably mounted on the leg with the collar to be manually turned to tightly clamp a portion of the attaching plate between the collar and the disc to provide a rigid mounting for the leg.

A further embodiment of the present invention is where the third basic embodiment is modified by defining that the brace has an inner end which is attached to a sleeve and the leg is cylindrical and the sleeve is pivotally mounted on the leg directly adjacent the outer end of the leg.

A further embodiment of the present invention is where the third basic embodiment is modified by defining that the brace is arcuately shaped.

A further embodiment of the present invention is where the third basic embodiment is modified by defining that the upper surface is planar.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 3:
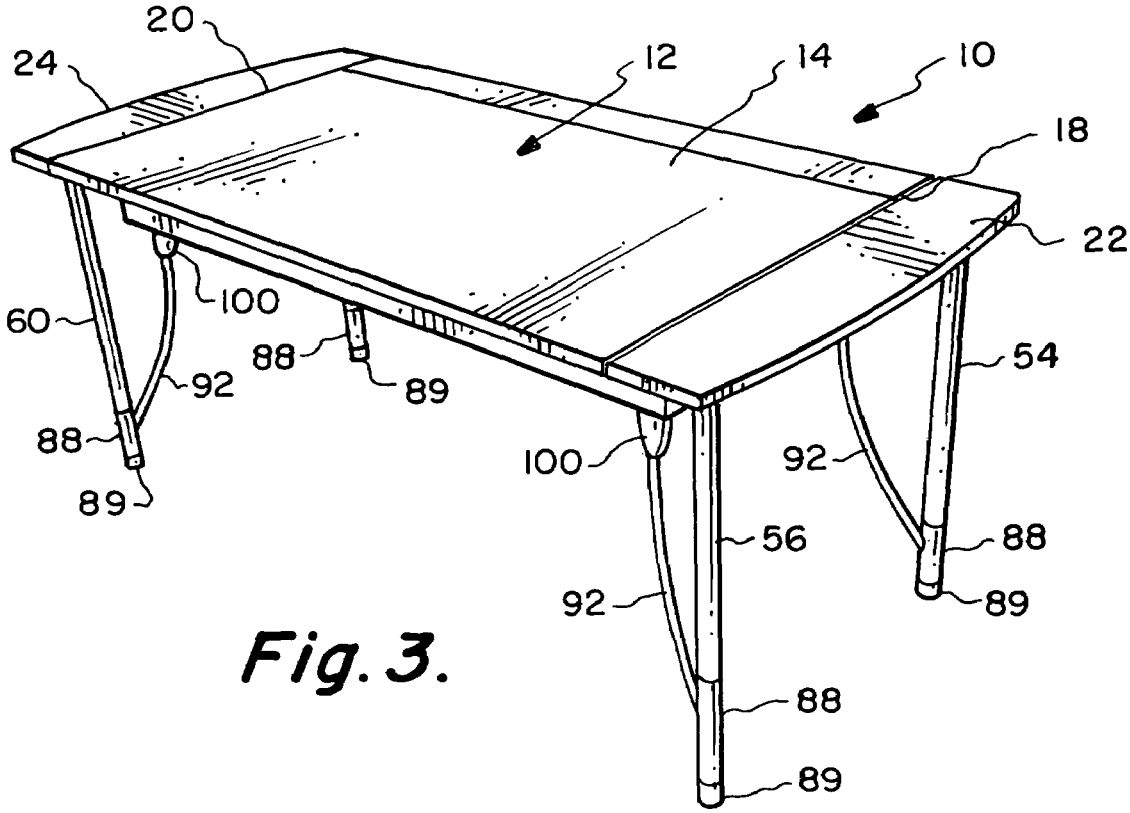
FIG. 3 is an isometric view showing the desk in its usage position.

Referring particularly to FIG. 3 of the drawings, there is shown the collapsible desk 10 of this invention that is intended to rest on a supporting surface, such as a floor (not shown). The collapsible desk 10 utilizes a working platform 12 which is basically rectangular in configuration and of sheet material construction (about one to two inches thick). The working platform 12 has an upper surface 14 which is planar and a bottom surface 16 which is also planar. The working platform 12 has a right edge 18 and a left edge 20.

A right leaf 22 is to be mounted in conjunction with the right edge 18. A left leaf 24 is to be mounted in conjunction with the left edge 20. The right leaf 22 and the left leaf 24 are generally constructed of the same material of construction as the working platform 12 with each of the leaves 22 and 24 being of sheet material construction and of the same size. However it is to be noticed when looking at the drawings, particularly FIGS. 1 and 3, that the leaves 22 and 24 are substantially smaller in size than the main part of the working platform 12 located between the leaves 22 and 24. The leaves 22 and 24 are deemed to be part of the working platform 12. It is to be understood that the upper surface 14 of the working platform 12 is to be the primary surface that will used by a human user to perform tasks, such as writing, accounting, reading, etc. plus having available the upper surfaces of the leaves 22 and 24.

Fixedly mounted to the undersurface 26 of the right leaf 22 is a mounting plate 28. The mounting plate 28 has a pair of extensions 30 and 32 secured thereto, such as by welding. Extension 30 is pivotally connected by a pivot pin 34 to an extension 36 which is fixedly mounted on the bottom surface 16. There is a similar extension 38 mounted on the bottom surface 16 that is located in alignment with the extension 32. A pivot pin 40 is to connect extensions 32 and 38.

Figure 1:
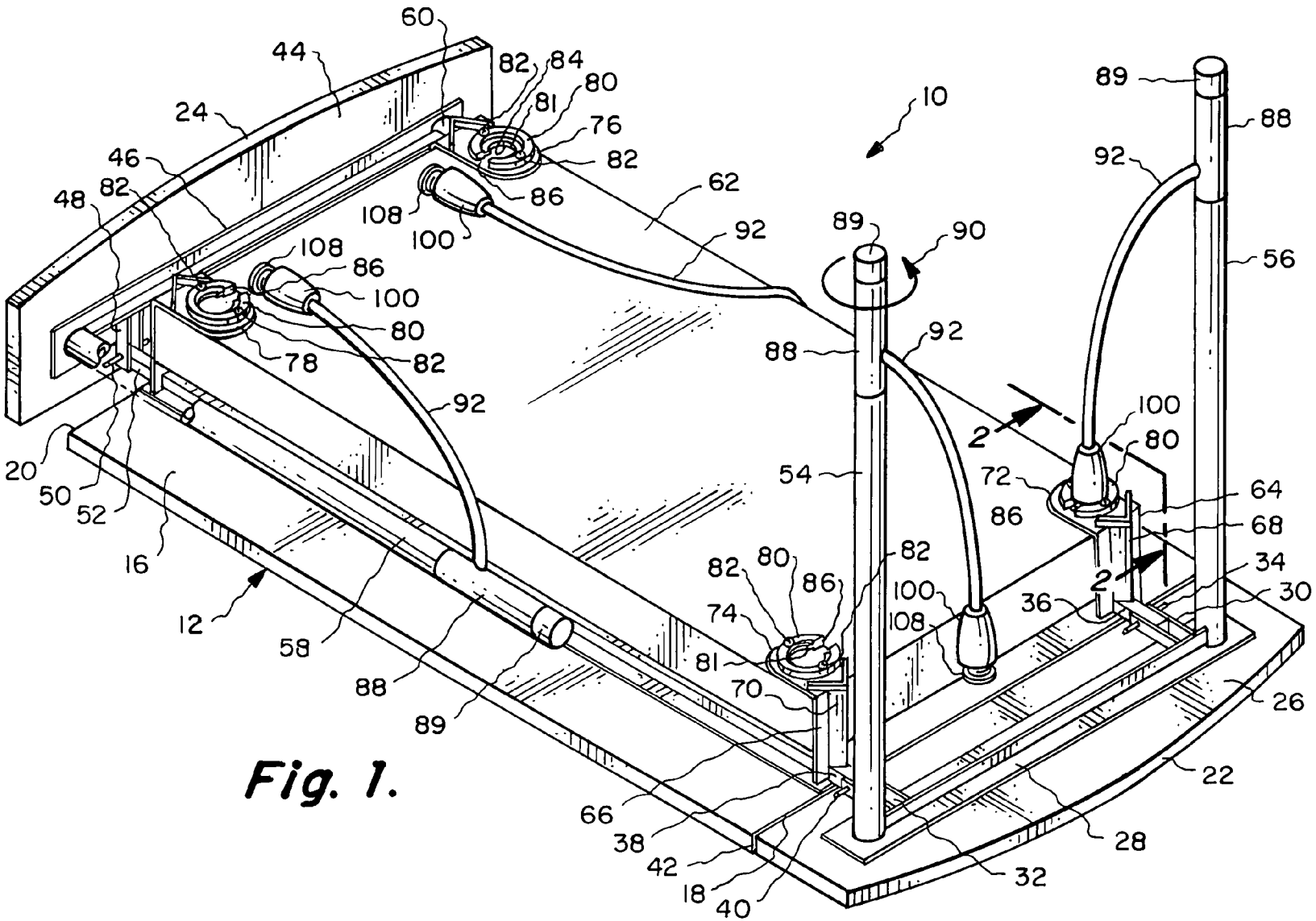
FIG. 1 is a bottom side isometric view of the collapsible desk of the present invention showing some legs in the retracted position and other legs in the extended position.
Figure 2:
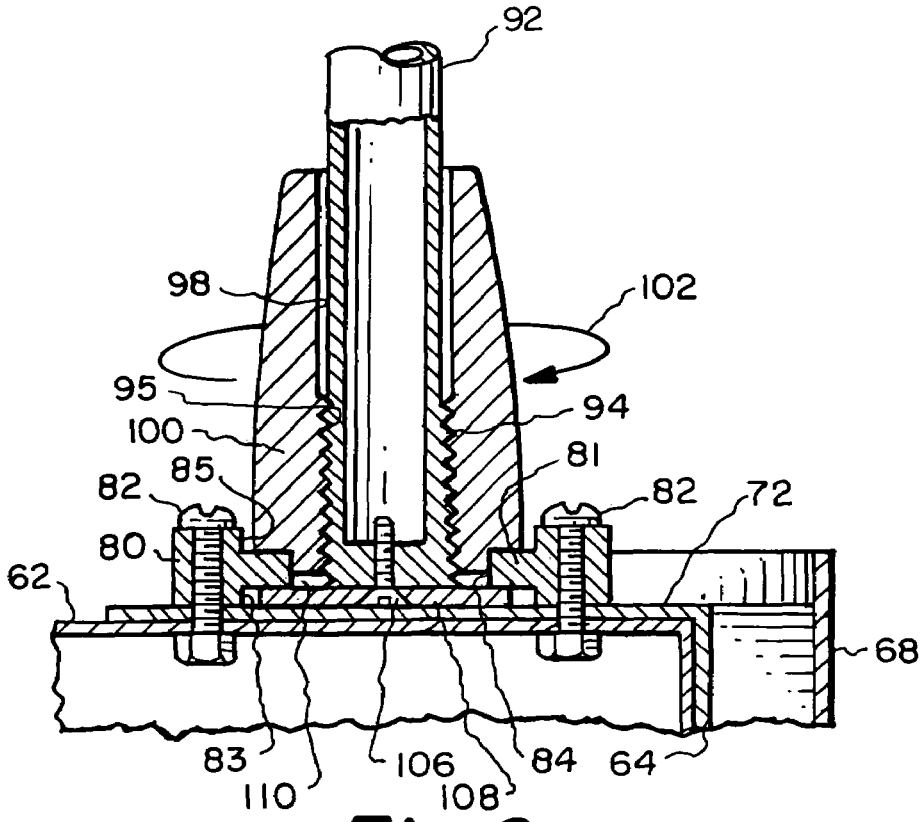
FIG. 2 is a longitudinal cross-sectional view through the securement that connects the brace for each leg to an attaching plate that is fixedly mounted relative to the working platform of the desk.

The right leaf 22 is capable of being located in an aligned position with the working platform 12, as is shown in FIGS. 1 and 3 of the drawings, and when in the aligned position there is formed a gap area 42 located between the right leaf 22 and the working platform 12. The right leaf 22 can be pivoted to a right angled position, which is the position shown by the left leaf 24. In that position, the right leaf 22 would be facing the left leaf 24 in FIG. 1. The left leaf 24 has an undersurface 44 on which is fixedly mounted a mounting plate 46 which is basically identical to mounting plate 28. Fixedly connected and extending from the mounting plate 46 is a pair of extensions with only extension 48 being shown. Connecting with extension 48 is a pivot pin 50 with this pivot pin 50 connecting with a separate extension 52 that is fixedly mounted to the bottom surface 16 of the working platform 12. It is to be understood that there will be separate extensions 48 and 52 and a separate pivot pin, which is not shown, at the opposite end of the mounting plate 46. There will also be a separate pivot pin, which is not shown. The result is that the left leaf 24 can be pivoted between the right angled or transverse position, shown in FIG. 1, to an aligned position, which is basically shown in FIG. 3.

Fixedly mounted to the mounting plate 28 and extending outwardly therefrom are a pair of legs 54 and 56. The legs 54 and 56 comprise elongated cylindrical members. The legs 54 and 56 are attached also to the right leaf 22. A similar pair of legs 58 and 60 are fixedly mounted to the mounting plate 46 and leaf 24. It is to be understood that the construction of the legs 54-60 are basically identical.

When the right leaf 22 is in the right angled position, the legs 54 and 56 are in juxtaposition to the bottom surface 16. Similarly, when the left leaf 24 is in the right angled position, as shown in FIG. 1, the legs 58 and 60 are in juxtaposition with the bottom surface 16.

Fixedly mounted onto the bottom surface 16 is a drawer housing 62. It is to be understood that the usage of the drawer housing 62 is deemed to be optional, but more than likely would be preferred so that drawers can be mounted in conjunction with the desk 10. The extension 36 is attached to a vertical member 64 which is mounted along the side edge of the drawer housing 62. The extension 38 is fixedly secured to a vertical member 66 which is also abuts against a side edge of the drawer housing 62. The vertical member 64 includes an outwardly extending V-shaped brace 68. A similar V-shaped brace 70 is included in conjunction with the vertical member 66. The upper end of the V-shaped brace 68 and the vertical member 64 is fixedly secured to an attaching plate 72. A similar attaching plate 74 is fixedly secured to the upper end of the vertical member 66 and also the upper end of the V-shaped brace 70.

In conjunction with the opposite side edge of the drawer housing 62, there will be used identical construction members which will include attaching plates 76 and 78. The attaching plates 72, 74, 76 and 78 are all mounted on the bottom surface of the drawer housing 62.

Mounted on each attaching plate by bolt fasteners 91 and 93, and is considered to be a part thereof, is a ring 80. There is to be a separate ring 80 fixedly mounted to each attaching plate 72, 74, 76 and 78 and also to the drawer housing 62 by means of bolt fasteners 82. Each ring 80 has a center opening 84. An open slot 86 forms a gap area within the confines of the ring 80 and connects with the center opening 84. Ring 80 has an inwardly extending horseshoe shaped flange 81. Beneath flange 81 is a chamber 83 which is larger in diameter than opening 84. Above flange 81 is a ledge 85. Each slot 86 is to be positioned on its respective attaching plate 72, 74, 76 and 78 so that the slots 86 of attaching plates 72 and 74 face each other and are in alignment and that slots 86 of attaching plates 76 and 78 also face each other and are in alignment.

Mounted on the outer end of each leg 54, 56, 58 and 60 is a sleeve 88. The sleeve 88 is basically cylindrical and in essence forms part of the cylindrical legs 54, 56, 58 and 60. Exteriorly of each sleeve 88 on each leg 54, 56, 58 and 60 is a foot 89 which is integral with the leg. Each of the feet 89 is to rest on a supporting surface, such as a floor of a house or building. The sleeve 88 is capable of pivotable movement relative to the remaining portion of the legs 54, 56, 58 and 60. This pivotable movement is depicted by arrow 90 in FIG. 1. Fixedly attached to each sleeve 88 is a brace 92. It is to be understood that there is a separate brace 92 for each sleeve 88. The basic construction of each brace 92 is that of a rod-like material that is basically arcuately shaped forming a slight curvature. This slight curvature is clearly shown in FIGS. 1 and 3. The outer free end of each brace 92 includes a threaded section 94. The threaded section 94 threadably engages with threaded section 95 that is formed within the wall surface of an opening 98 of a collar 100. The collar 100 is capable of pivotable movement, as indicated by arrow 102, which causes the collar 10 to longitudinally move by threaded section 95 pivoting relative to threaded section 94. Threadably connected to brace 92 is a bolt fastener 106 which secures disc 108 to brace 92. Formed between the disc 108 and the collar 100 is an annular gap 110.

With the legs 54, 56, 58 and 60 in the extended position, the brace 92 can be swung from its unengaged position to a locking position with the disc 108 passing through the slot 86 of its respective attaching plate 72 for leg 56, attaching plate 74 for leg 54, attaching plate 76 for leg 60 and attaching plate 78 for leg 58. The disc 108 will be located underneath the ring 80 in chamber 83. By maintaining the disc 108 in a fixed relationship, the user can then apply a turning torque to the collar 100, as indicated by arrow 102. This turning torque will cause the collar 100 to threadably move until the bottom edge of collar 100 tightly abuts against the ring 80. The collar 100 binds against flange 81. The collar 100 is laterally restrained by the ledge 85 and it is impossible for the collar 100 to become accidentally disengaged from its attaching plate (72, 74, 76 and 78). If it were not for ledge 85, it is possible that the collar 100 would have a tendency to "walk" out of engagement with its attaching plate. Ledge 85 prevents this. At this time, each of the legs 54, 56, 58 and 60 are now securely positioned in the extended position. In this extended position, the extensions 30 and 36, 32 and 38, 48 and 52, as well as the pair of extensions which are not shown, only permit the leaves 22 and 24 to pivot no further than being in alignment with the working platform 12. It would be undesirable to have the leaves 24 pivot to any upwardly angled position relative to the upper surface 14.

It is to be understood that the user can quickly and easily move each of the legs 54, 56, 58 and 60 to the extended position and then swingingly move each of the braces 92 into an engaging position and then tighten the collar 100 in a matter of a few moments of time. This means that in a matter of a few moments that the collapsible desk of this invention is now placed in the usage position and then can be turned over from the position shown in FIG. 1 to the usage position in FIG. 3.

If the user so desires at some time and wishes to move the desk 10 to the collapsed position, it is only necessary that the user would turn the desk over and loosen each of the collars 100 and move the braces 92 about ninety degrees which will then permit each of the legs 54, 56, 68 and 60 to be folded to be in juxtaposition with the bottom surface 16 of the working platform 12. Transportability of the collapsible desk 10 is then facilitated.

It is considered to be within the scope of this invention that each of the legs 54, 56, 58 and 60 could be mounted directly onto the bottom surface 16 of the working platform 12. In that particular situation, either there would be a single leg located directly adjacent a corner of the working platform 12. There would be no leaves 22 and 24 but only the working platform 12. Each of the legs 54, 56, 58 and 60 would be mounted by being fixed as being screw threadingly tightened with a connector that is embedded within the working platform 12. There still would be utilized a brace 92 in conjunction with each leg 54, 56, 58 and 60 which would operate in the same way. At the outer end of each brace 92 there would be a collar 100 which would connect with an attaching plate similar to attaching plate 72, 74, 76 and 78 for each leg. The attaching plates can be mounted on a drawer housing, such as drawer housing 62, or could be mounted directly on bottom surface 16. Instead of the legs folding to a collapsed position, in this particular embodiment each of the legs would be removable from the working surface 12 and then placed alongside of the working platform 12 in juxtaposition with the bottom surface 16.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. Collapsible furniture, comprising:

a planar working platform spaced above a floor surface, said planar working platform having a top upon which objects are to be laid and a bottom at which is located a plurality of locking members;

leaves pivotally coupled to respective opposite sides of said working platform so as to be rotatable between a first position in planar alignment with said working platform and a second position folded downwardly with respect to said working platform towards the floor surface;

at least one leg connected to each leaf at each side of said working platform and extending from said leaf at an angle of 90 degrees, said one leg rotating with said leaf between said first position at which said leg supports said working platform above the floor surface and said second position at which said leg lies against the bottom of said working platform, said leg remaining at all times connected to said leaf and extending therefrom at said 90 degree angle during the rotation of said leg with said leaf from said first position to said second position;

a sleeve coupled to a corresponding said at least one leg and adapted to rotate around said leg between a locked position and an unlocked position; and a brace connected at one end thereof to the sleeve of said corresponding said one leg and having a locking member at the opposite free end, said sleeve being rotated around said leg to the locked position when said leaves are in said first position at which the locking member of said brace is moved into detachable interlocking engagement with a corresponding one locking member of said plurality of locking members at the bottom of said working platform, and said sleeve being rotated around said leg to the unlocked position when said leaves are in said second position at which the respective locking members of said brace and said working platform are detached from one another such that said brace is separated from said working platform.

2. The collapsible furniture recited in claim 1, wherein said planar working platform is a desk top.

3. The collapsible furniture recited in claim 2, wherein said brace has an arcuate shape, said brace being connected between the sleeve coupled to said at least one leg and one of said leaves at one side of said working platform to prevent a rotation of said leaf from said first position and folding upwardly with respect to said working platform away from the floor surface.

4. The collapsible furniture recited in claim 1, wherein the locking member of said brace includes a disk and the locking member of said working platform includes a flange, the disk of said brace moving into said detachable interlocking mating engagement with the flange of said corresponding one locking member of said plurality of locking members at the bottom of said working platform.

5. The collapsible furniture recited in claim 1, wherein the corresponding one of said plurality of locking members at the bottom of said working platform is a receptacle having a central opening, a side opening communicating with said central opening, and a locking flange surrounding said central opening, the locking member of said brace carrying a disc moving laterally through said side opening to be removably received by the central opening of said receptacle and located below the locking flange thereof, whereby the respective locking members of said brace and said working platform lie in said detachable interlocking engagement with one another.

6. The collapsible furniture recited in claim 5, further comprising a screw-threaded locking collar surrounding said brace, said brace having a screw-threaded portion running therealong, and said screw-threaded locking collar being rotated around the screw-threaded portion of said brace so as to move axially towards and into engagement with the locking flange surrounding the central opening of the receptacle of the corresponding one locking member of said plurality of locking members at the bottom of said working platform, whereby to lock the disc carried by the locking member of said brace below said locking flange.

7. A piece of furniture, comprising:

a planar working platform spaced above a floor surface, said planar working platform having a top upon which objects are to be laid and a bottom at which is located a plurality of locking members;

a plurality of legs connected to said working platform at the bottom thereof to support said working platform above the floor surface;

a sleeve coupled to a respective one of said plurality of legs and adapted to rotate around said leg between a locked position and an unlocked position;

a brace connected at one end thereof to the sleeve of a corresponding said one leg and having a locking member at the opposite free end, said sleeve being rotated around said leg to the locked position at which the locking member of said brace is moved into detachable interlocking engagement with a corresponding one locking member of said plurality of locking members at the bottom of said working platform, and said sleeve being rotated around said leg to the unlocked position at which the respective locking members of said brace and said working platform are detached from one another whereby said brace is separated from said working platform, the corresponding one locking member at the bottom of said working platform including a receptacle having a central opening, an opening through a side of said receptacle communicating with said central opening, and a locking flange surrounding said central opening at the interior of said receptacle, and the locking member of said brace carrying a disc moving laterally through said opening in the side of said receptacle to be removably received by the central opening of said receptacle and located below the locking flange thereof, whereby the respective locking members of said brace and said working platform lie in said detachable interlocking engagement with one another; and a screw-threaded locking collar surrounding said brace, said brace having a screw-threaded portion running therealong, and said screw-threaded locking collar being rotated around the screw-threaded portion of said brace so as to move axially towards and into engagement with the locking flange surrounding the central opening at the interior of the receptacle of the corresponding one locking member of said plurality of locking members at the bottom of said working platform, whereby to lock the disc carried by the locking member of said brace below said locking flange.

8. The piece of furniture recited in claim 7, wherein said planar working platform is a desk top.

9. The piece of furniture recited in claim 7, further comprising a leaf pivotally coupled to one side of said planar working platform, said leaf being rotatable relative to said working platform from a first position in planar alignment with said working platform to a second position folded downwardly with respect to said working platform, the one leg of said plurality of legs being at all times fixedly connected to and rotated with said leaf from said first position to said second position.

10. The piece of furniture recited in claim 9, wherein said one leg extends from said leaf at an angle of 90 degrees at all times during the rotation of said leaf and said one leg fixedly connected thereto from said first position to said second position, said one leg lying against the bottom of said planar working platform when said leaf is rotated to said second position.

* * * * *